US009090060B2

(12) United States Patent
Cleare

(10) Patent No.: US 9,090,060 B2
(45) Date of Patent: Jul. 28, 2015

(54) INKJET PRINTHEAD DRIVER CIRCUIT AND METHOD

(71) Applicant: Inca Digital Printers Limited, Cambridge (GB)

(72) Inventor: Hamilton Buchanan Cleare, Cambridge (GB)

(73) Assignee: Inca Digital Printers Limited (GB)

( * ) Notice: Subject to any disclaimer, the term of this patent is extended or adjusted under 35 U.S.C. 154(b) by 0 days.

(21) Appl. No.: 14/359,956

(22) PCT Filed: Nov. 23, 2012

(86) PCT No.: PCT/GB2012/052914
§ 371 (c)(1),
(2) Date: May 22, 2014

(87) PCT Pub. No.: WO2013/076510
PCT Pub. Date: May 30, 2013

(65) Prior Publication Data

US 2015/0015627 A1 Jan. 15, 2015

(30) Foreign Application Priority Data

Nov. 23, 2011 (GB) ..... 1120228.0

(51) Int. Cl.
*B41J 29/38* (2006.01)
*B41J 2/045* (2006.01)

(52) U.S. Cl.
CPC ..... *B41J 2/04573* (2013.01); *B41J 2/0455* (2013.01); *B41J 2/04541* (2013.01); *B41J 2/04548* (2013.01); *B41J 2/04581* (2013.01)

(58) Field of Classification Search
CPC ..... B41J 2/04541; B41J 2/04548; B41J 2/04573; B41J 2/04581; B41J 2/0455; B41J 2/04588
USPC ..... 347/9–12, 40
See application file for complete search history.

(56) References Cited

U.S. PATENT DOCUMENTS 6,089,689 A 7/2000 Suzuki
6,422,685 B1 7/2002 Kondo et al.

(Continued)

FOREIGN PATENT DOCUMENTS

GB 2480822 A 12/2011
JP 2000218782 A 8/2000

(Continued)

OTHER PUBLICATIONS

Campolo, Domenico, et al., "Efficient Charge Recovery Method for Driving Piezoelectric Actuators with Quasi-Square Waves", IEEE Trans. on Ultrasonics, Ferroelectrics, and Fequency Control, vol. 50, No. 1, Jan. 2003, pp. 1-10.
International Search Report and Written Opinion for Application No. PCT/GB2012/052914 dated Oct. 7, 2013.
Search Report for Application No. GB1120228.0 dated Mar. 22, 2012.

*Primary Examiner* — An Do

(74) *Attorney, Agent, or Firm* — Lerner, David, Littenberg, Krumholz & Mentlik, LLP

(57) ABSTRACT

A drive circuit for repetitively energising a printhead (10) to eject drops of ink and a method of operating the drive circuit are described. The printhead h multiple nozzle channels each having a respective capacitance. The drive circuit includes a first switching element (S1) connected to couple a drive connection of the printhead to a first connection of a power supply (V1) via a first inductor (L1) to provide a charge path for current to charge the capacitance of at least one nozzle channel to a desired operating voltage. The drive circuit further includes a second switching element (S2) connected to couple a drive connection of the printhead to a second connection of the power supply (V1) via a second inductor (L2) to provide a discharge path for current to discharge the capacitance of said at least one nozzle channel to a desired interpulse voltage.

20 Claims, 12 Drawing Sheets

(56) References Cited

U.S. PATENT DOCUMENTS

| | | | | |
|---|---|---|---|---|
| 6,443,547 | B1 | 9/2002 | Takahashi et al. | |
| 7,746,127 | B2 * | 6/2010 | Miyazaki et al. | 327/112 |
| 8,974,024 | B2 * | 3/2015 | Otsuka et al. | 347/10 |

FOREIGN PATENT DOCUMENTS

| | | | |
|---|---|---|---|
| JP | 2004306395 | A | 11/2004 |
| JP | 2009166292 | A | 7/2009 |

* cited by examiner

INKJET PRINTHEAD DRIVER CIRCUIT AND METHOD

CROSS REFERENCE TO RELATED APPLICATIONS

The present application is a national phase entry under 35 U.S.C. §371 of International Application No. PCT/GB2012/052914, filed Nov. 23, 2012, published in English, which claims priority from GB 1120228.0 filed Nov. 23, 2011, the disclosures of which are hereby incorporated herein by reference.

Printheads for ink jet printers are typically piezo electric. Piezo electric elements have capacitance and energy is typically dissipated in rapidly charging and discharging the capacitance to a desired voltage through the intrinsic circuit resistance to eject ink drops. These problems are an issue in high speed high volume printheads where significant power is dissipated, leading both to energy wastage and cooling problems. In systems driving large arrays of printheads, this power dissipation can be significant, requiring large DC power supplies to provide the energy and large heatsinks to dissipate the waste heat.

An inductive energy recovery circuit for driving capacitive loads, such as single piezo actuators, have been described in Efficient Charge Recovery Method for Driving Piezoelectric Actuators with Quasi-Square Waves by Domenico Campolo, Metin Sitti, and Ronald S. Fearing (IEEE Trans. On Ultrasonics, Ferroelectrics, And Frequency Control, Vol. 50, No. 1, January 2003).

It has been proposed to incorporate inductance in a drive circuit for a piezo electric element as energy can be recycled between an inductor (which stores energy as a function of current flowing) and a capacitor, as is well known in electrical theory.

However, when theoretical circuits are applied to practical printheads, it is found that issues arise. It is problematic to achieve desired rapid charging and discharging without unwanted ringing and the pulse repetition rate can be adversely affected (which in a printer translates to resolution reduction or printing time increase). Also it is found that in a printhead adding an inductor can reduce uniformity of print as printhead voltages may fluctuate.

The present invention provides a drive circuit for repetitively energising a printhead to eject drops of ink, the printhead having multiple nozzle channels each having a respective capacitance, the drive circuit comprising: a first switching element connected to couple a drive connection of the printhead to a first connection of a power supply via a first inductor to provide a charge path for current to charge the capacitance of at least one nozzle channel to a desired operating voltage; and a second switching element connected to couple a drive connection of the printhead to a second connection of the power supply via a second inductor to provide a discharge path for current to discharge the capacitance of said at least one nozzle channel to a desired inter-pulse voltage.

By providing separate switching elements with separate inductors for charge and discharge phases, it has been found that a high pulse repetition rate can be achieved without dissipating energy in resistive losses. The separate inductors can allow the charge and discharge phases to be overlapped and each can be more precisely controlled. It has been found that one cause of variation in a circuit with a single inductor is that the energy stored may be in an indeterminate state between pulses, partly due to variation in the capacitance of the head. With separate inductors for charge and discharge it is easier to have the charge path in a known state. This use of a pair of inductors offers greater flexibility in the timing of the voltage pulse, allowing higher pulse repetition frequencies to be achieved and permitting more stable operation when parasitic capacitances are present. As will be apparent, this use of a pair of inductors could be applied to control circuits for other piezo electric devices and benefit from the same advantages.

The inductors may be of differing values to give desired slope times which may be different for charge and discharge, and may be tailored to physical characteristics of a printhead. Moreover, the interaction of the inductor and the capacitor can allow the capacitor to be charged to a higher voltage than the power supply voltage, as the charge circuit can behave as a voltage doubler; this avoids the need for a separate voltage step-up circuit. By way of example only, a typical print head drive voltage of about 90 volts may be generated directly from a 48 volt bus voltage.

In one embodiment, the circuit is capable of generating a sustained voltage greater than that of the supply rail. In one implementation, a circuit element which permits current flow in only one direction is connected in series between the first inductor and printhead drive connection to faciliate the voltage doubler operation. The circuit element acts as a current blocking device and may be implemented in the circuit as a diode. The device allows current of the charge path to flow into the capacitance of at least one nozzle channel. The use of the current blocking device enables the circuit to sustain a voltage on the capacitive load that is higher than the circuit's supply rail voltage (although voltages lower than the supply rail voltage may actually be generated in some implementations).

A diode can be particularly advantageous in implementing the current blocking functionality. In particular, a diode requires no special control and its low parasitic capacitance can allow for efficient operation of the circuit. Other current blocking elements may also be used in some implementations, however, such as a transistor or FET.

A further circuit element which permits current flow in only one direction, such as a second diode, is preferably connected in series between the second inductor and printhead drive connection to inhibit reverse current flow from the second inductor. The second diode allows current of the discharge path to flow out from the capacitance of at least one nozzle channel.

Preferably the drive circuit further comprises a third switching element connected between the second inductor and the first connection of the power supply. This enables a flyback current pathway for the energy stored in the second inductor, thereby improving efficiency.

An additional circuit element which permits current flow in only one direction, such as a third diode, is preferably connected in series between the second inductor and the first power supply connection to facilitate the flyback operation. The third diode allows current of the discharge path to flow back to the first power supply connection.

Preferably the drive circuit further comprises a fourth switching element connected between the first inductor and the second connection of the power supply. This can be used to provide a boost by causing (increased) current to flow in the first inductor to store energy, to achieve boost to a voltage higher than double the power supply voltage.

A yet further circuit element which permits current flow in only one direction, such as a fourth diode, is preferably connected in series between the first inductor and the second power supply connection to facilitate the boost operation, enabling current to flow when the first switch is open to provide a ground reference (assuming the second power supply connection is deemed ground, or other potential). The fourth diode allows current to flow from the second power supply connection to the first inductor.

A still further circuit element which permits current flow in only one direction, such as a fifth diode, is preferably connected in series between the second inductor and the second power supply connection to facilitate discharge operation from higher voltages, enabling current in the second inductor to flow to the first power supply connection. The fifth diode allows current to flow from the second power supply connection to the second inductor.

The switching elements may be transistors, particularly field effect transistors. Preferably a control arrangement provides drive waveforms for the switching elements to provide switching directly between substantially fully on and fully off, the on and off switching times being selected to provide the desired drive voltage based on the time for which current flows in the first inductor.

Where the fourth switching element is provided, the control arrangement may be arranged to switch between a boost mode in which the fourth switching element is used and a normal mode based on the desired voltage. This may be based on a chosen operating regime; it may be found that although a given voltage is achievable in both modes, it is more efficient to operate in one mode than another.

Preferably the printhead drive terminal is connected to supply power to a plurality of nozzle channels, the nozzle channels being connected to a return path, typically coupled to the second power supply connection, wherein each of the plurality of nozzle channels is connected in series with a respective nozzle switching element. In this way, the power circuit need not be replicated for all nozzle channels and there may be one power circuit for an entire head or even for several heads, the nozzle printing being controlled by the nozzle switching elements. The nozzle switching elements may be smaller and may be arranged to switch only at times when power is not being supplied by the drive connection from the drive circuit to reduce dissipation in the nozzle switching elements.

Preferably the control arrangement is arranged to adjust the drive circuit in dependence on the number of nozzle channels being fired based on information concerning the individual nozzle switching elements or a measure of the number of active nozzle channels for a given drive pulse. This may enable a uniform printing to be achieved unaffected by variations in total capacitance. This feature may be provided independently in a drive circuit for a printhead arranged to supply drive power pulses to a plurality of individually switched nozzle channels characterised by means for adjusting a parameter of the drive circuit based on a measure of the number of nozzle channels active for a given pulse.

Preferably, the drive circuit has at least one inductor in the drive output and wherein the drive circuit has at least one compensating capacitor in parallel across the printhead and drive terminal to reduce the variation in load capacitance with the number of active nozzles. This, in a normal circuit, would be counter-intuitive because it would merely increase the power needed to drive the print head. However, its presence together with an inductor provides the advantage of stabilizing timing and which outweighs this downside.

In a related aspect, the invention provides determining a measure of the number of nozzle channels of a printhead expected to be active for a given drive pulse and providing a control parameter to circuitry generating the drive pulse to compensate for variation in nozzle channel capacitance.

In a related aspect, to reduce the dynamic range of adjustment, the invention provides a compensating circuit for a printhead having a plurality of nozzle channels each having a capacitance and wherein a plurality of nozzle channels are connected to a common drive connection and in series with individual nozzle control switching elements, the circuit comprising a compensating capacitance arrangement connected to the drive connection to reduce the variation in overall capacitance presented to the drive circuit with variation in the number of active nozzle channels.

The compensating capacitance arrangement may be a fixed capacitor having a capacitance substantially one third the total head capacitance with all nozzle channels active. Additionally or alternatively, the compensating capacitance arrangement may include one or more additional capacitances coupled via a switching element or via respective switching elements to the drive terminal and control means may be provided for switching additional capacitances to reduce variation in overall capacitance based on the number of active nozzle channels. The additional capacitances may be arranged in binary relation, for example one capacitance of approximately half the difference between maximum and minimum printhead capacitance, one of a quarter and one of an eight will reduce the dynamic variation to approximately 12% with only 3 capacitances and a fourth would give approximately 6%.

In a further aspect where a drive circuit for a printhead has an adjustable parameter for controlling pulse voltage, preferably a control arrangement is provided for measuring actual nozzle channel voltages and adjusting the parameter based on measurements. This is most advantageously achieved with the circuit of the first aspect by adjusting timing values based on measured voltages. Most preferably adjustments are made based on both a measure of voltage and a measure of the number of active nozzle channels.

In one embodiment, measurements of actual pulse voltage may be used to adjust the timing coefficients in order to achieve a desired constant pulse voltage independently of the load presented by the printhead. In some situations, particularly due to crosstalk in the printheads, for a given drive voltage the drop mass and drop velocity can be dependent on the number of droplets being fired from the printhead. Therefore, in some embodiments, the control system could be used to set the generated pulse voltage to a known (non-constant) function of the number of droplets being fired. In this way, the circuit can compensate to some extent for crosstalk effects within the printhead.

In printing, the optical density of the printed drops on the substrate can be a key factor and an image scanner can be used to measure this. So rather than aiming for constant voltage, or constant drop mass, the present system could be used in some implementations to aim for constant ink density independently of the number of nozzles being fired in a printhead. The system could also be arranged to keep variation of the voltage, drop mass and ink density within acceptable tolerances and therefore a function of one of these variables, or a combination of more than one of these variables may be controlled.

As will be apparent, preferred features of each aspect may be applied with other aspects and method aspects may be provided as corresponding apparatus, for example logic or circuits, and vice versa.

Further features and advantages of the invention will be better understood from the following detailed description, which is given by way of example and in association with the accompanying drawings of which:

Figure 1:
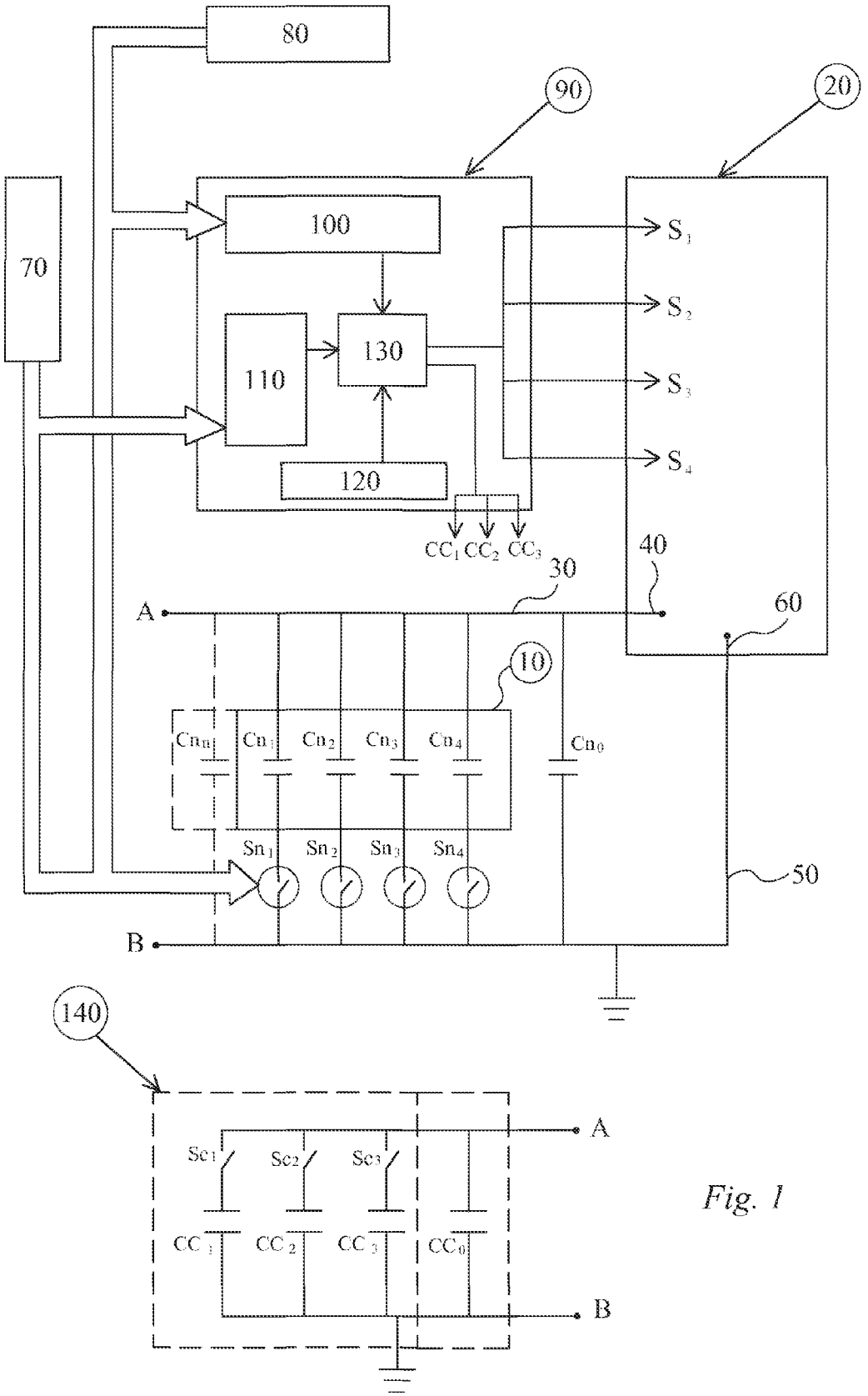
FIG. 1 shows a schematic diagram of a circuit for energising a printhead.
Figure 2:
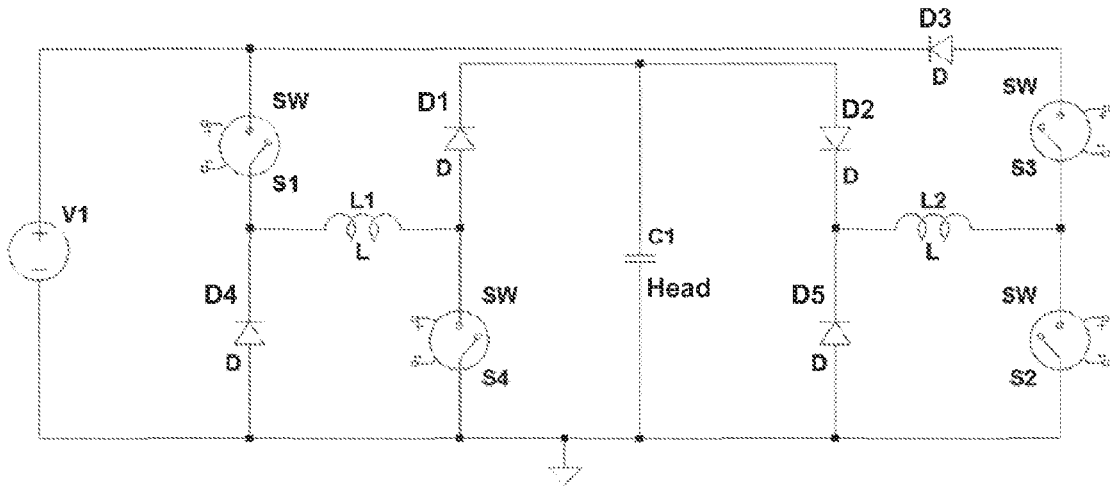
FIG. 2 shows a simplified schematic diagram of a pulse generation circuit.
Figure 14:
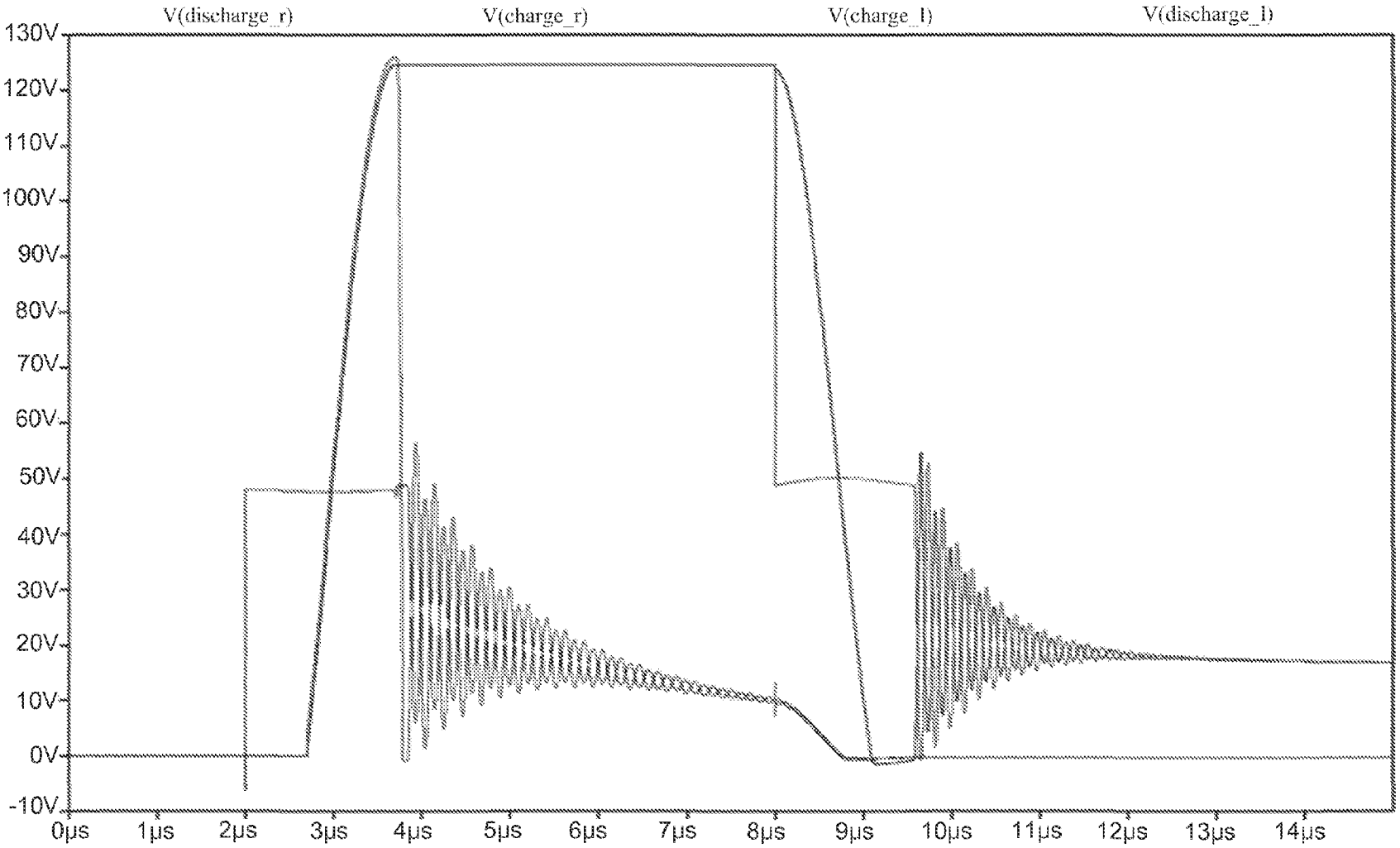
Figure 15:
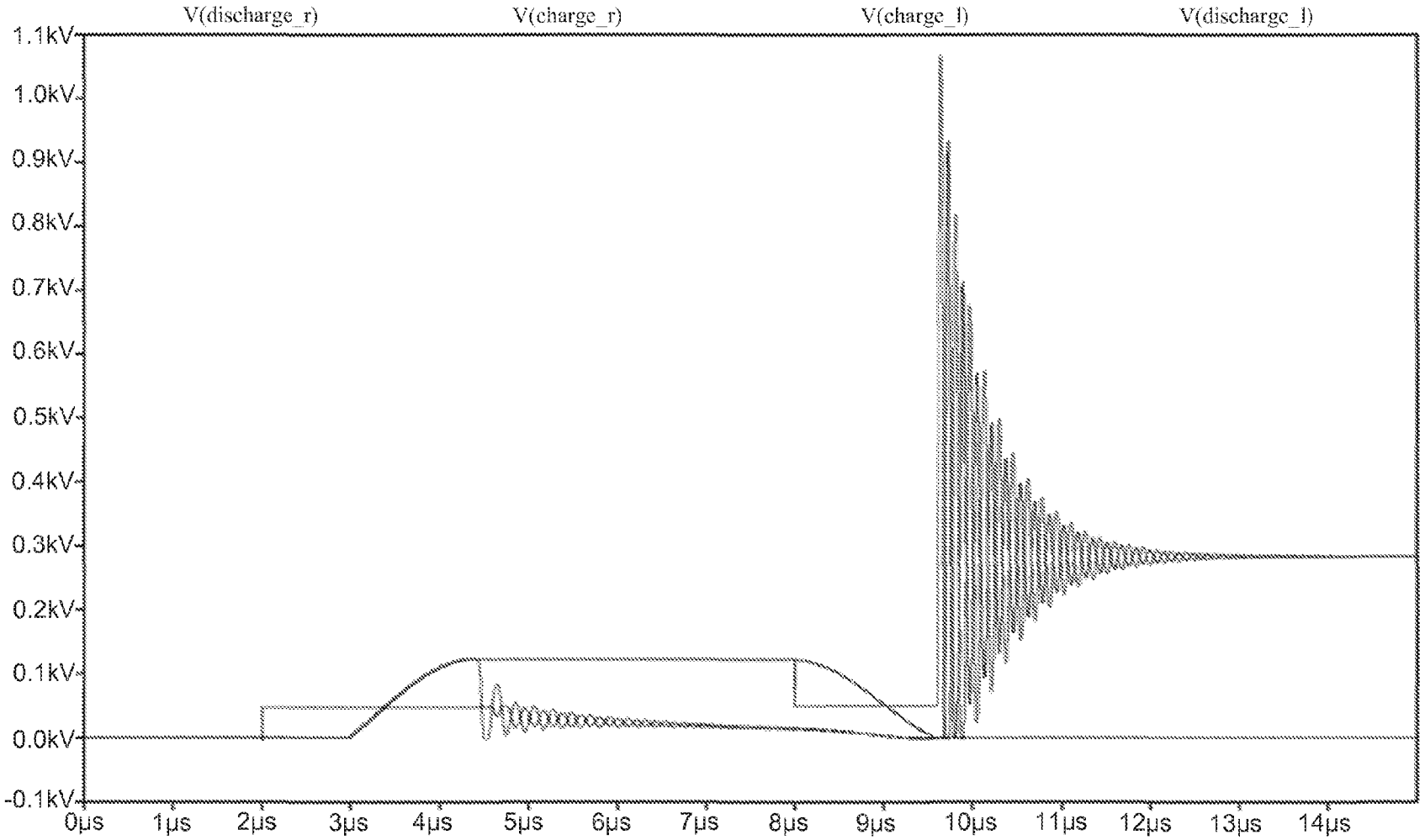

FIG. 14 shows discharge voltage waveforms (less than 2×HT pulse 10 n load); and FIG. 15 shows discharge voltage waveforms which occur at premature termination of flyback signal Referring to FIG. 1, there is shown a schematic diagram of a control or drive circuit for repetitively energising a printhead 10 to eject drops of ink. The printhead has multiple nozzle channels each with a respective capacitance Cn1, Cn2, Cn3, Cn4 . . . Cnn which are repetitively energized by the pulse generation circuit 20, as shown in FIG. 2, to eject drops of ink. The print head has its own inherent capacitance Cn0 indicated in parallel across the nozzle channels. A printhead drive terminal 30 connects the nozzle channels to a first power supply connection 40 from the pulse generation circuit 20. The nozzle channels are connected by a current return path 50 to a second power supply connection 60 to the pulse generation circuit 20. Each nozzle channel is connected in series with a respective nozzle switching element Sn1, Sn2, Sn3, Sn4 . . . Snn controlled by a print data source 70 and a timing data source 80.

The drive circuit comprises a control arrangement 90 to drive wave forms for switching elements S1, S2, S3, S4 in the pulse generation circuit 20. The control arrangement receives data from the print data source 70 and the timing data source 80. The timing data is processed by a timing generator 100. The print data is processed by a counter 110 to count the active nozzle channels at any one time based on the print data. The control arrangement has a memory chip 120 storing a table of desired power supplies to the nozzle channels. Logic 130 is supplied information from the timing generator 100, counter 110 and look-up memory 120 in order to drive the switching elements S1, S2, S3, S4 in the pulse generation circuit 20.

In a development, the drive circuit also comprises a compensating circuit 140 with one or more actively switched compensating capacitors Cc1, Cc2, Cc3 connected in parallel with a fixed compensating capacitor Cc0. Each compensating capacitor is connected in series with a respective switching element Sc1, Sc2, Sc3 controlled by the control arrangement 90. The compensating circuit is connected in parallel with the printhead 10 via terminals A and B. The fixed compensating capacitor has a capacitance of approximately one third of the total head capacitance with all nozzle channels active. By switching capacitances in dependence on the number of active nozzle channels, the variation in overall capacitance can be reduced. The capacitances may be arranged in binary magnitude, compensating capacitor Cc1 may be half compensating capacitor Cc0, compensating capacitor Cc2 may be half compensating capacitor Cc1, compensating capacitor Cc3 may be half compensating capacitor Cc2 so that variation may be reduced to about 10%.

The pulse generation circuit operation is discussed with reference to FIGS. 2 to 9.

Referring to FIG. 2 there is shown a simplified schematic diagram of the pulse generation circuit. The switches control the flow of current between the power rail, the printhead capacitance and the inductors.

Various switching sequences, resulting in charging or discharging of the printhead capacitance C1, will now be described with reference to FIGS. 3 to 5.

Figure 3:
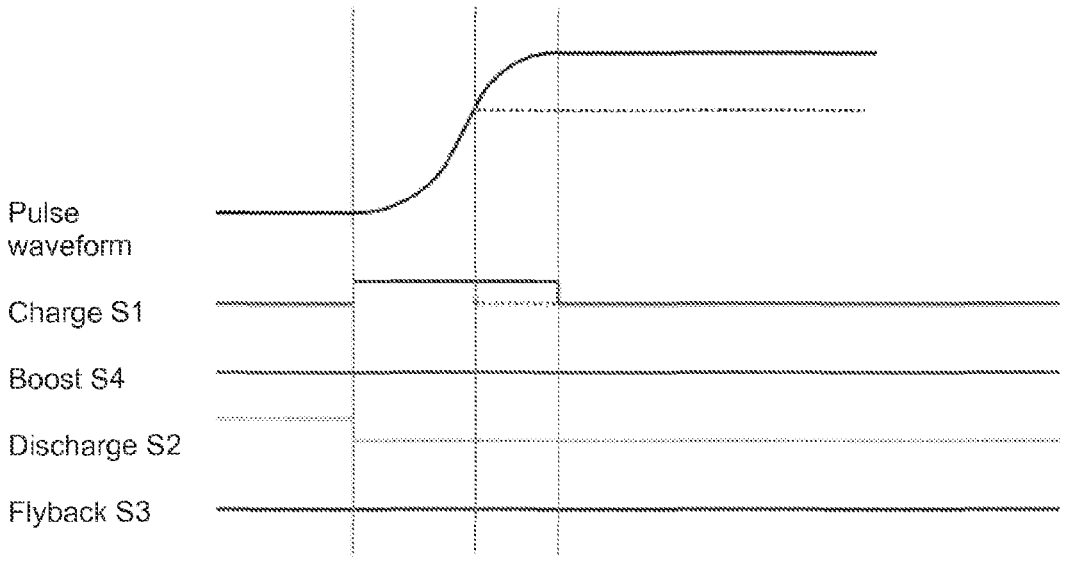
FIG. 3 shows the circuit of FIG. 2 charging the capacitance of a printhead nozzle channel.

Referring in particular to FIG. 3, closure of first switching element S1 charges printhead capacitance C1 via a first inductor L1 and a first diode D1. Such a circuit can generate a voltage on the capacitor approaching twice the DC supply voltage, as is shown by the solid line in FIG. 3. However, by opening the first switching element S1 before the resonant transfer of energy from the first inductor L1 to printhead capacitance C1 has completed, any voltage up to this voltage can be generated, as is shown by the dashed lines in FIG. 3.

Figure 4:
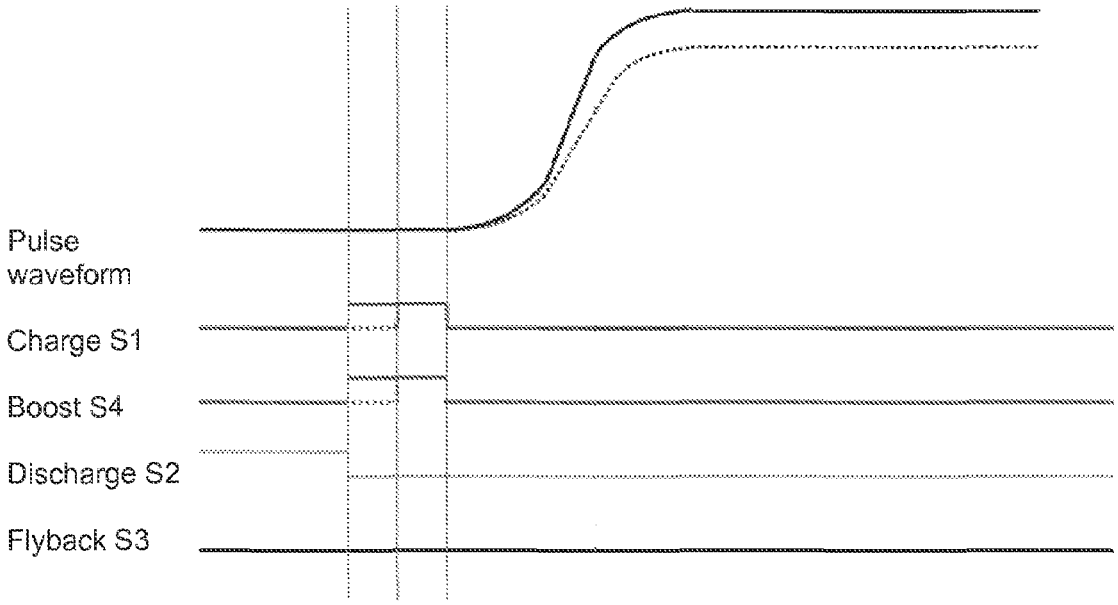
FIG. 4 shows the circuit of FIG. 2 charging to more than double the supply voltage, relative to ground.

Referring in particular to FIG. 4, there is shown how the circuit charges to more than double the supply voltage, relative to ground potential. First switching element S1 and fourth switching element S4 are closed simultaneously, causing the current through the first inductor L1 to increase linearly with time. The greater the inductor charging time, the more energy is stored in the inductor's magnetic field. When first and fourth switching elements S1 and S4 are simultaneously open-circuited, there is a partially resonant exchange of energy from the first inductor L1 to the printhead capacitance C1, thus charging it up relative to a ground reference established through a fourth diode D4. The voltage attained will be a multiple of the supply rail voltage, the multiplier factor being approximately equal to the charging time divided by $\sqrt{(L1*C1)}$. The effect of a shorter charging time is shown by the dashed lines of FIG. 4.

Figure 5:
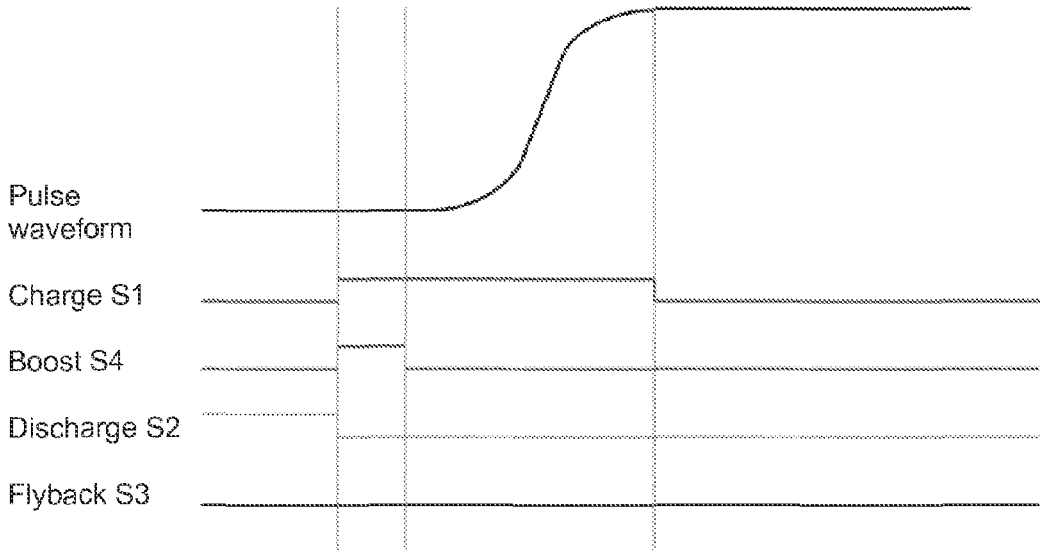
FIG. 5 shows the circuit of FIG. 2 charging to more than double the supply voltage, relative to supply.

Referring in particular to FIG. 5, there is shown how the circuit charges to more than double the supply voltage, relative to ground potential. By keeping first switching element S1 closed after opening fourth switching element S4, the capacitor is charged in a way similar to the previous description, except the voltage is now established with respect to the supply rail (through first switching element S1) as is shown in FIG. 4. Hence a higher voltage than previously is established for the same inductor charging time: this leads to more efficient operation. In practice, a combination of the above schemes may be used in order to give a wide range of output voltages. Discharging of the printhead capacitance C1 is discussed below with reference to FIGS. 6 and 7.

Figure 6:
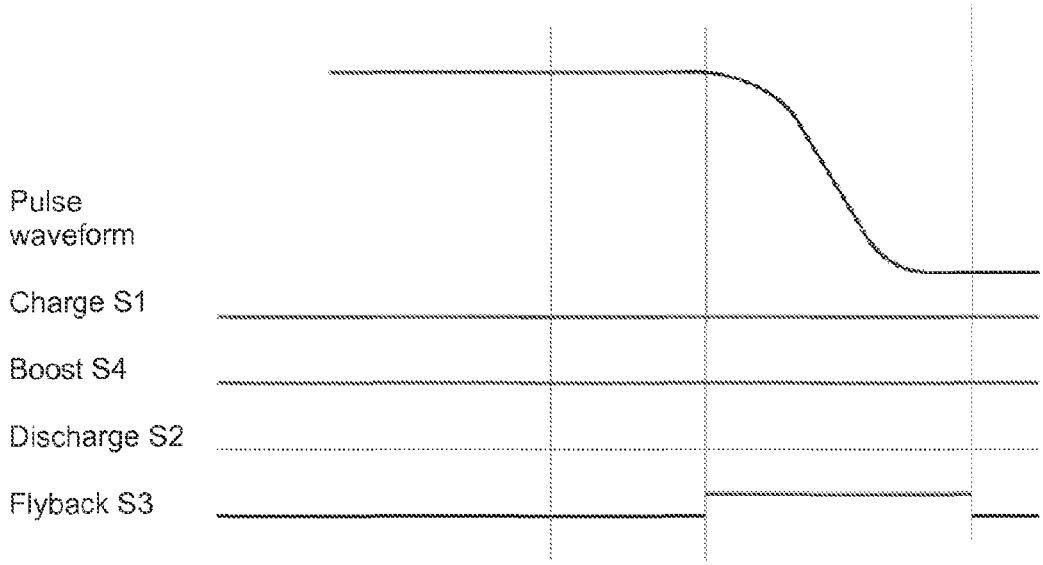
FIG. 6 shows the circuit of FIG. 2 discharging with pulse voltages greater than double the supply.

Referring in particular to FIG. 6, there is shown how the circuit discharges with pulse voltages greater than double the supply. When a third switching element S3 is closed, current flows from printhead capacitance C1 through a second diode D2, a second inductor L2 and a third diode D3 to the supply rail. If the initial pulse voltage is sufficiently high, by the time the voltage on the capacitor has been reduced to the supply rail voltage, the current established in the inductor L2 will be sufficiently high to draw the remaining charge out of the capacitor, reducing the voltage to zero, as is shown in FIG. 6. Any current still flowing in the second inductor L2 at this point flows via a fifth diode D5 and a third diode D3 to the supply rail. In a practical circuit, this method works when the pulse voltage is at least 2.7 times greater than the supply voltage.

Figure 7:
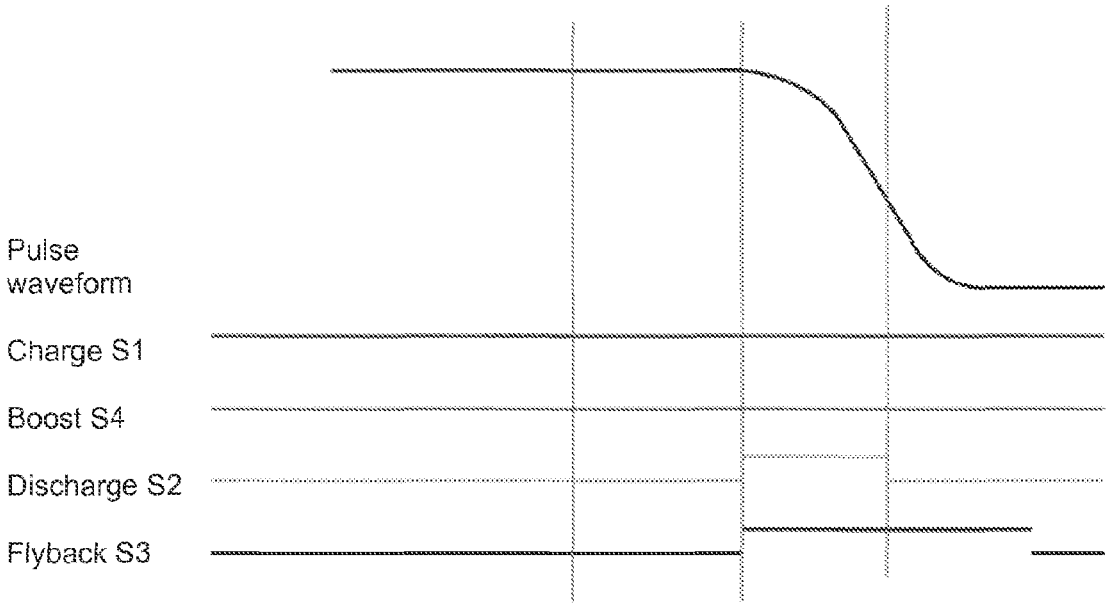
FIG. 7 shows the circuit of FIG. 2 discharging with pulse voltages less than double the supply.

Referring in particular to FIG. 7, there is shown how the circuit discharges with pulse voltages less than double the supply. Discharging with Pulse Voltages Less than Double the Supply. When a second switching element S2 is closed (it is convenient to close switching element S3 at this point) current starts to flow from the printhead capacitance C1 through the second diode D2, the second inductor L2 and second switching element S2 to ground potential. When a sufficient current is flowing in the second inductor L2, the second switching element S2 can be turned off. At this point at this point the current now flows from printhead capacitance C1, through the second diode D2, the second inductor L2, the third switching element S3 and the third diode D3 to the supply rail, until printhead capacitance C1 is fully discharged to 0 volts. Any current still flowing in the second inductor L2 at this point flows via the fifth diode D5 and the third diode D3 to the supply rail, as is shown by FIG. 7.

Figure 8:
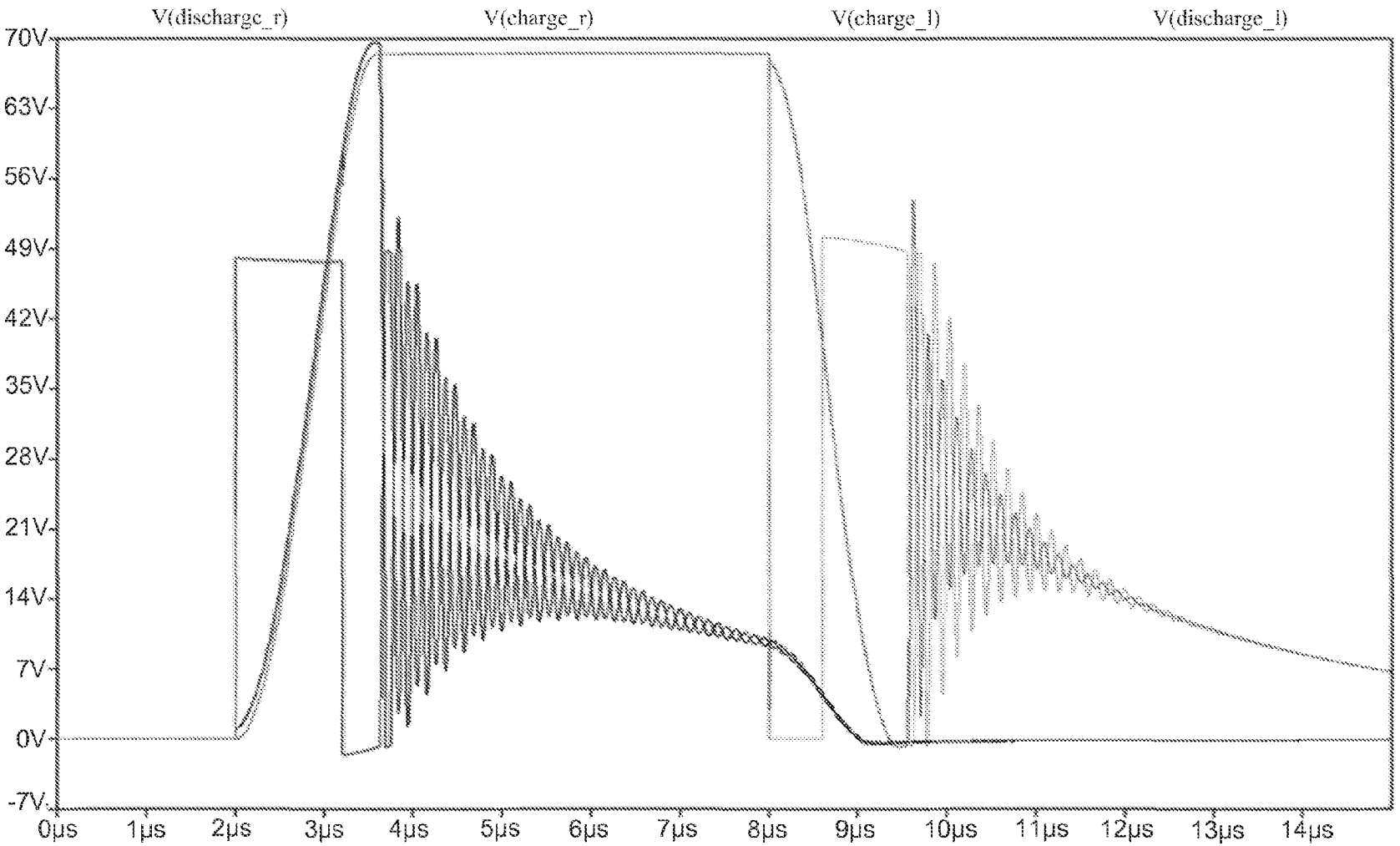
FIG. 8 shows dissipation of energy from the inductors to avoid "ringing"

Referring to FIG. 8, the benefit of dual inductor topology is discussed. Following the discharge of an inductor, at the point at which the current becomes zero, there is often a voltage across the inductor and also across any associated stray capacitances (such as inter-winding capacitance in the inductor or capacitance in the semiconductor switches). If the operation of the switches leaves the inductor effectively open circuit then "ringing" of the voltage across the inductor can occur due to resonant energy transfer between the inductor and the stray capacitance. In order to achieve consistent charging of the inductor, it is helpful if this energy can be fully dissipated before the inductor is next charged. The dual inductor topology allows full current discharge and oscillations in one inductor to decay whilst the other inductor is actively transferring current between the capacitor and supply rail.

A further advantage of the dual inductor topology is that inductor L1 can be charged with current at the same time that inductor L2 is being used to transfer charge from the capacitor C1 to the supply rail. Hence it is possible to charge printhead capacitance C1 from the first inductor L1 shortly after it has been discharged into the second inductor L2 (allowing for the decay of parasitic oscillations). In this manner a very high pulse repetition rate can be achieved, with the limiting waveform appearing approximately sinusoidal.

A third advantage is that the pulse rise and fall times are determined by the LC time constants of the circuit components. By using inductors of different values for the charge and discharge inductors, it is possible to set different pulse rise and fall times.

In a real printhead, the capacitance presented increases with the number of piezo channels which are firing ink. Hence a more realistic model for the load capacitance when N piezo channels are being fired is: C1=C0+N*Cn [where C0 is a constant capacitance due to the cabling and any fixed capacitor on the drive circuit, and Cn is the capacitance of a single piezo channel].

By using an additional load capacitance having a value of approximately one third the capacitance of the printhead when all nozzle channels are active, the dynamic range of loads over which the system must operate is reduced to the range [C0, 4*C0]. The extra energy stored in this load capacitance is mostly recovered during the capacitor discharge cycle, so the penalty in terms of extra power dissipation is acceptable. As discussed below, actively switched compensating capacitances reduce variation further and can be used with a secondary drive circuit.

As a consequence of the data-dependant capacitance, the charging times for the pulse generation circuit must be varied depending upon the data being printed in order to achieve a consistent drive voltage. This can be achieved in digital hardware by means of a simple counting circuit and look-up tables for the charging times.

Figure 9:
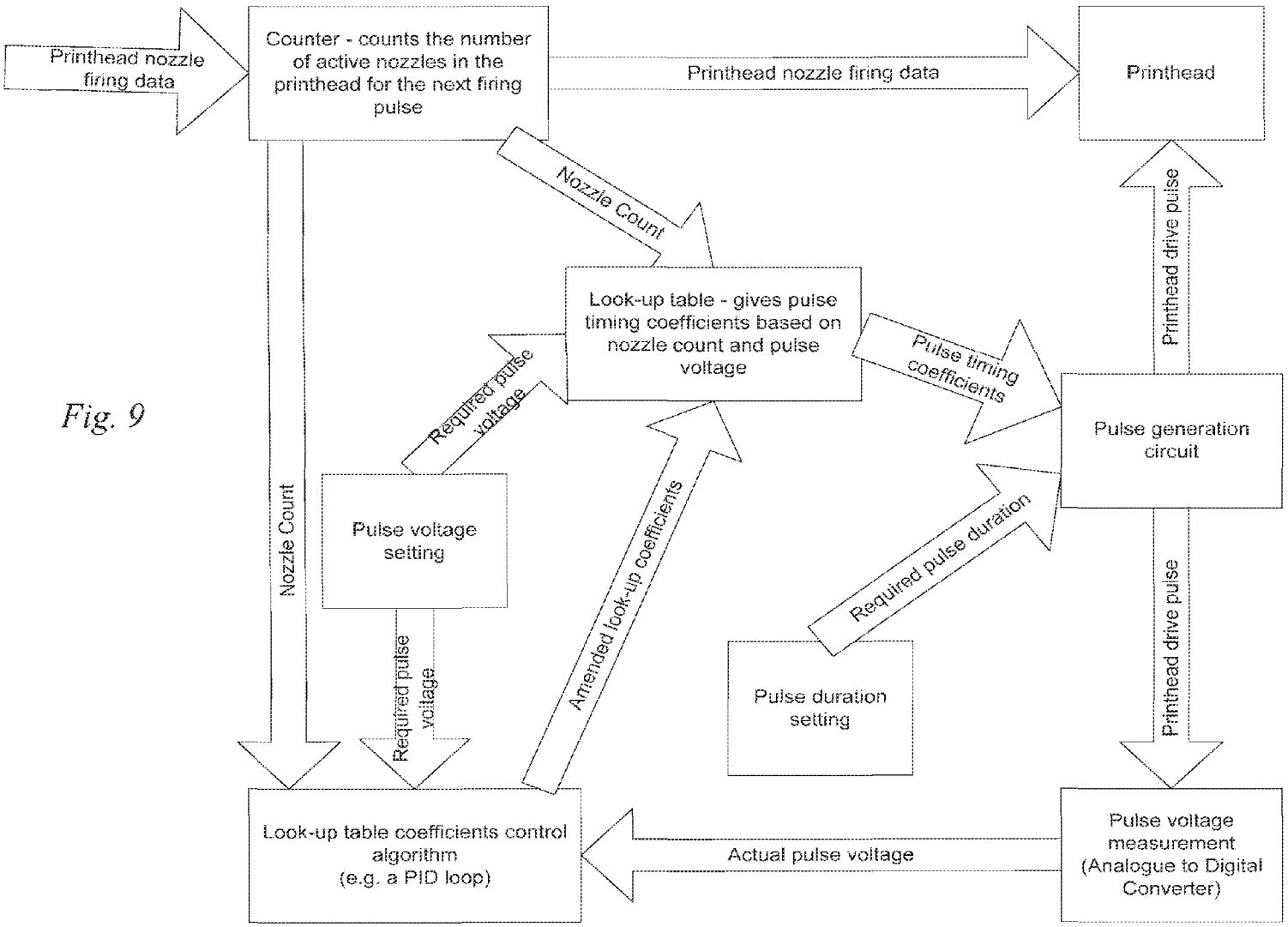
FIG. 9 shows a flow diagram of a feedback system.

Referring to FIG. 9, there is shown a flow diagram of a feedback system to achieve a stable pulse voltage. The pulse voltage generated has been shown to be related to the DC rail voltage, the charging inductance, load capacitance and charging times. It is known that these values, particularly the effective load capacitance, can change over time and may also exhibit some temperature dependence. Hence, in order to achieve a desired pulse voltage, it may be necessary to make fine adjustments to the inductor charging time throughout the operation of the pulse circuit. This may be achieved by measuring the generated voltage and comparing it with the desired voltage. Any error may be used as input to a control algorithm (such as a PID servo loop), which amends the inductor charging time based on the voltage error.

Values for the circuit components of FIG. 2 in this typical, non-limiting, application are as follows:

Inductor (L1 & L2)=typically 10 to 50 μH;

Capacitor (C1)=of the order of 10 nF (No nozzle channels firing) to 40 nF (All nozzle channels firing);

Rise and fall times=in the order of 1 μs;

Pulse duration=in the range 3 to 6 μs;

Pulse to pulse interval=10 μs all the way up to 1 ms and beyond;

Supply voltage=24V or 48V although any supply voltage is possible; and

Pulse voltage=typically in the range 60V to 120V although it can be in the lower range of 25V to 35V for some printheads.

Referring to FIGS. 10 to 14, the following are worked examples of 48 Volt operation of a typical drive circuit.

Figure 10:
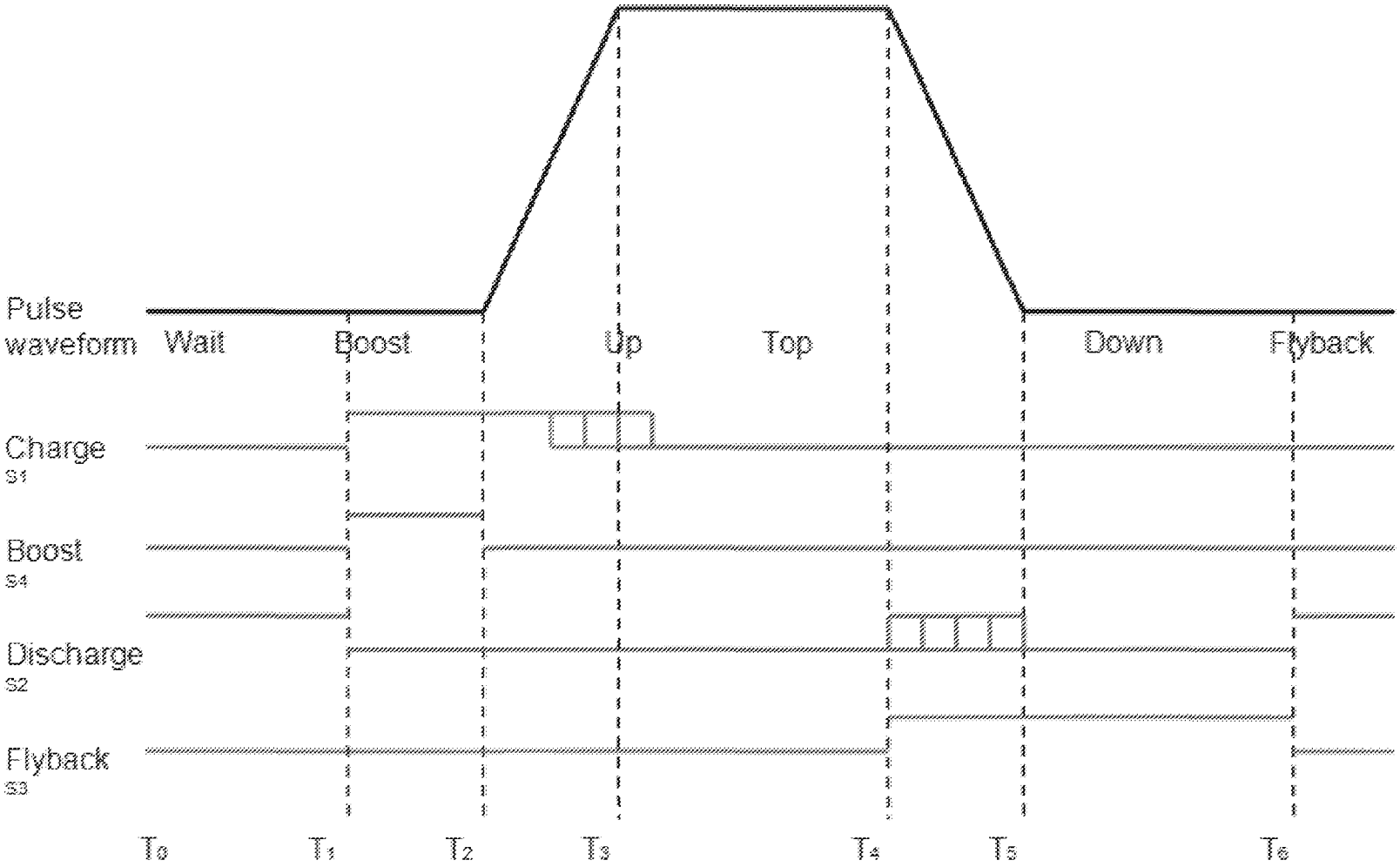
FIG. 10 shows switch timing relationships of worked examples of 48 Volt operation of the drive circuit.

Referring in particular to FIG. 10, there are shown the switch timing relationships according to the table below.

| State | Times | Devices active, Comments |
|---|---|---|
| Wait | $T_0$-$T_1$ | S2 output clamp function |
| Boost | $T_1$-$T_2$ | S1 and S4, for pulse voltages > ≈1.7 × HT. Can be 0uS. |
| Up | $T_2$-$T_3$ | S1 Inductor charge and release whilst driving load |
| Top | $T_3$-$T_4$ | This time contributes to the pulse length. |
| Down | $T_4$-$T_5$ | S3 and some S2 is required to make sure |
| Flyback | $T_5$-$T_6$ | S3 only. S2 must be off otherwise recovered energy is lost and the inductor discharge period is greatly extended. The period T4-T6 is typically longer than T1-T3, to ensure that all the energy is returned to the source, otherwise potentially dangerous flyback voltages will arise which will eventually destroy the circuit. Like wise S3 must be on when S2 turns off. |
| Wait | | S2 as output clamp |

Figure 11:
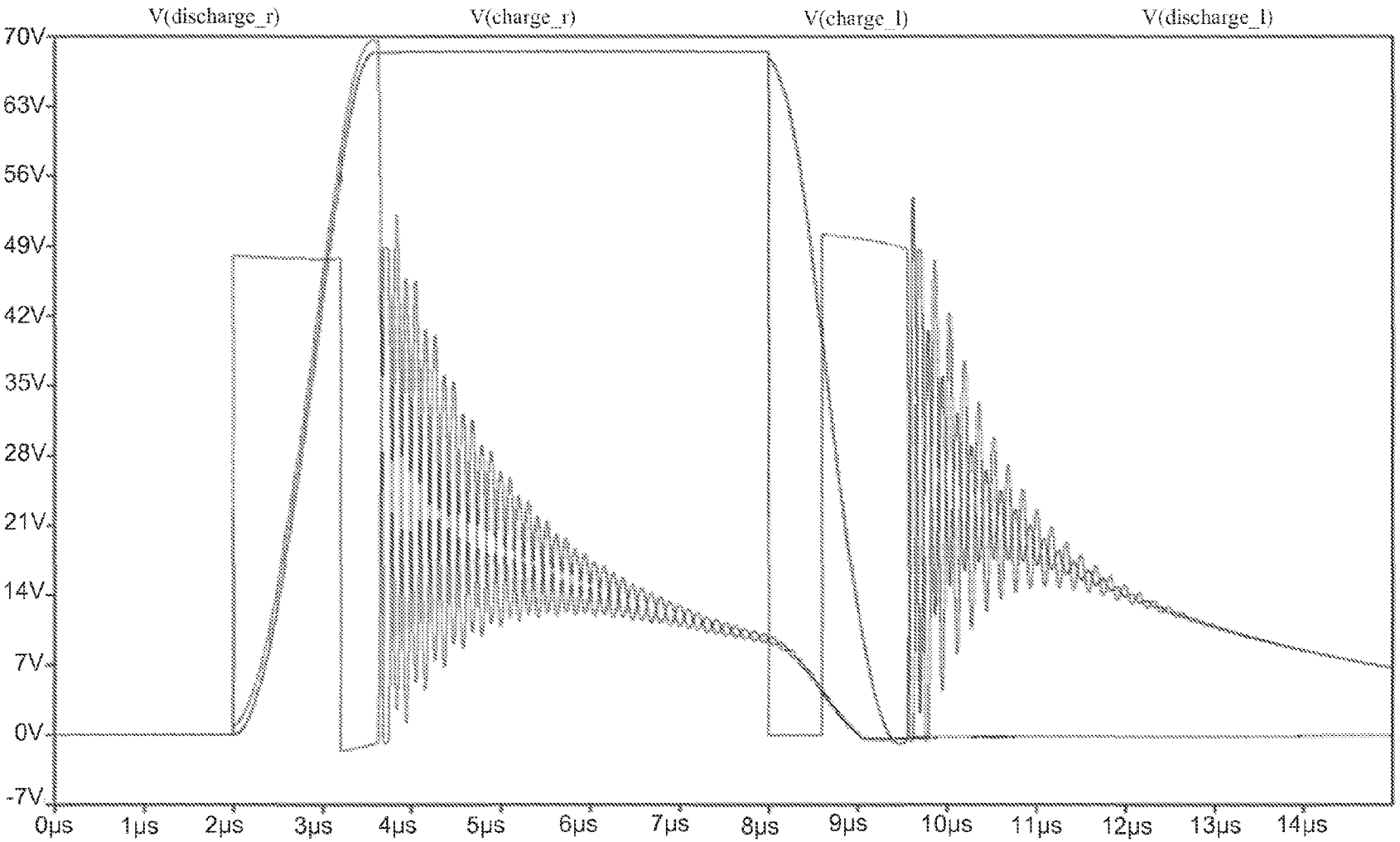
FIG. 11 shows discharge voltage waveforms (less than 2×HT pulse 10 n+10 n load)

Referring to FIG. 11, there is shown the discharge voltage waveforms (less than 2×HT pulse 10 n+10 n load) according with the switch timings of the table below.

| Name | Function | Delay | On | units | Comments |
|---|---|---|---|---|---|
| S1 | Charge L1 | 2.0 | 1.2 | uS | |
| S4 | Ground L1 | | | | Not required |
| S2 | Ground L2 | 8.0 | 0.6 | uS | To make sure comes back to load goes back to 0 volts |
| S3 | Flyback L2 | 8.0 | >1.6 | uS | |

Figure 12:
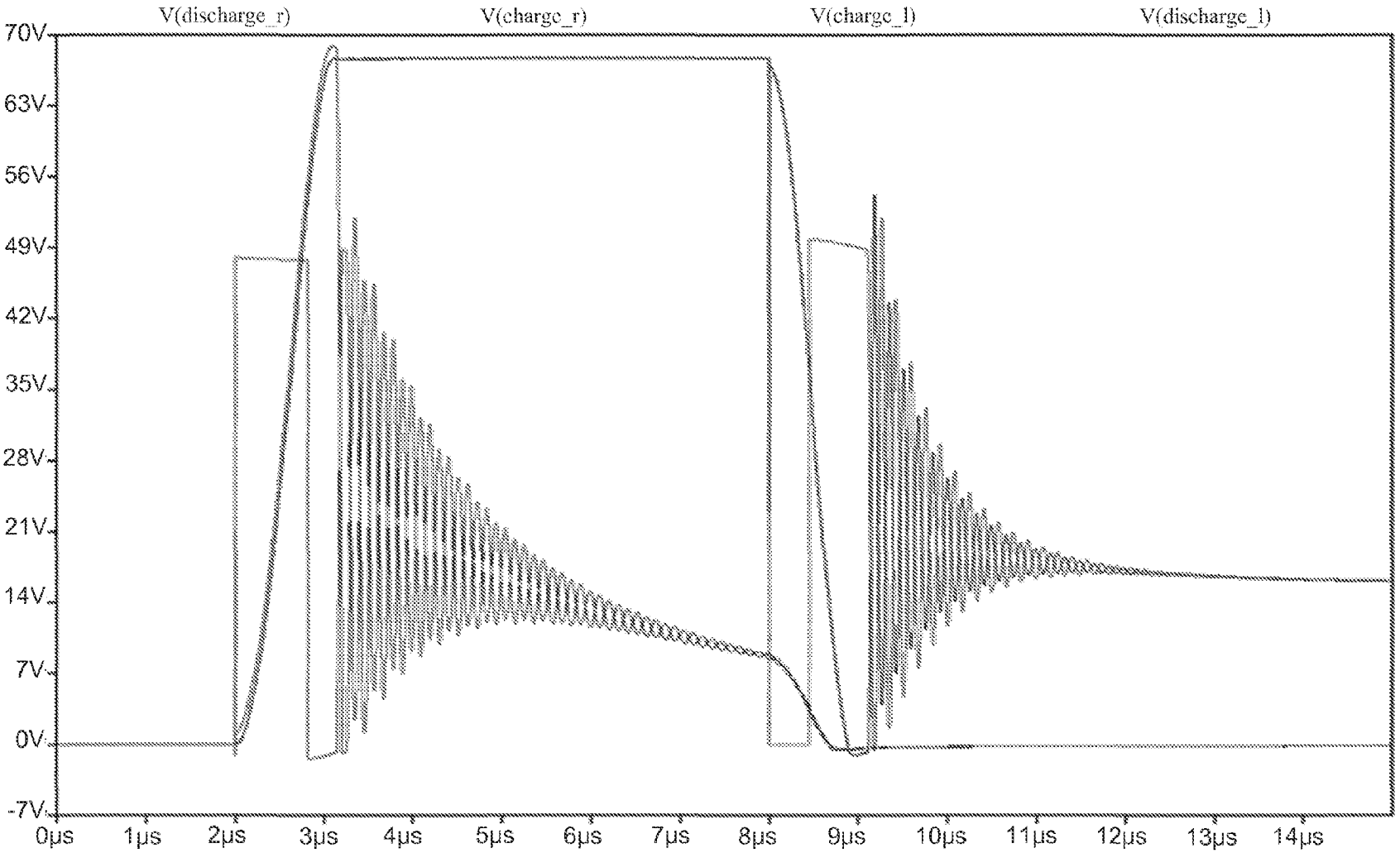
FIG. 12 shows discharge voltage waveforms (less than 2×HT pulse 10 n load)

Referring to FIG. 12, there is shown the discharge voltage waveforms (less than 2×HT pulse 10 n load) according with the switch timings of the table below.

| Name | Function | Delay | On | units | Comments |
|---|---|---|---|---|---|
| S1 | Charge L1 | 2.0 | 0.82 | uS | |
| S4 | Ground L1 | | | | Not required |
| S2 | Ground L2 | 8.0 | 0.45 | uS | To make sure comes back to load goes back to 0 volts |
| S3 | Flyback L2 | 8.0 | >1.1 | uS | |

Figure 13:
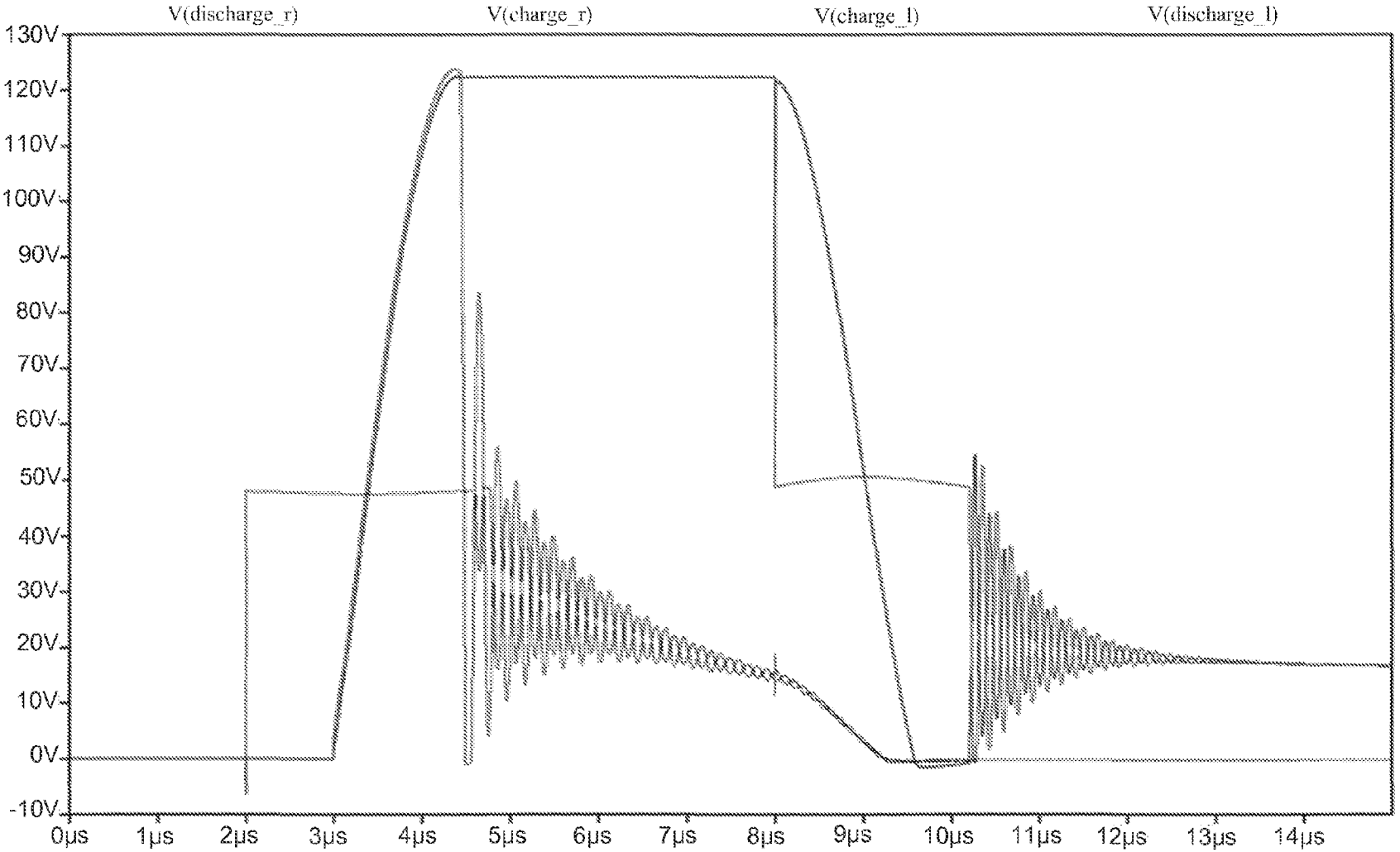
FIG. 13 shows discharge voltage waveforms (more than 2×HT pulse, 10 n+10 n load)

Referring to FIG. 13, there is shown the discharge voltage waveforms (more than 2×HT pulse, 10 n+10 n load) according with the switch timings of the table below.

| Name | Function | delay | On | units | Comments |
|---|---|---|---|---|---|
| S1 | Charge L1 | 2.0 | >2.5 | uS | |
| S4 | Ground L1 | 2.0 | 1.1 | uS | Extra charge in inductor to take over 2x HT |
| S2 | Ground L2 | | | | Not required * |
| S3 | Flyback L2 | 8.0 | >2.3 | uS | |

Referring to FIG. 14, there is shown the discharge voltage waveforms (less than 2×HT pulse 10 n load) according with the switch timings of the table below.

| Name | Function | delay | On | units | Comments |
|---|---|---|---|---|---|
| S1 | Charge L1 | 2.0 | >1.7 | uS | |
| S4 | Ground L1 | 2.0 | 0.7 | uS | Extra charge in inductor to take over 2x HT |
| S2 | Ground L2 | | | | Not required* |
| S3 | Flyback L2 | 8.0 | >1.6 | uS | |

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. A drive circuit for repetitively energising a printhead to eject drops of ink, the printhead having multiple nozzle channels each having a respective capacitance, the drive circuit comprising:

a first switching element connected to couple a drive connection of the printhead to a first connection of a power supply via a first inductor to provide a charge path for current to charge the capacitance of at least one nozzle channel to a desired operating voltage; and a second switching element connected to couple a drive connection of the printhead to a second connection of the power supply via a second inductor to provide a discharge path for current to discharge the capacitance of said at least one nozzle channel to a desired inter-pulse voltage.

2. The drive circuit as claimed in claim 1 wherein the desired operating voltage is greater than the voltage of the power supply.

3. The drive circuit as claimed in claim 1, wherein the drive circuit comprises a first circuit element which permits current flow in only one direction and which is connected in series between the first inductor and the printhead drive connection.

4. The drive circuit as claimed in claim 1, wherein the drive circuit comprises a second circuit element which permits current flow in only one direction and which is connected in series between the second inductor and the printhead drive connection.

5. The drive circuit as claimed in claim 1, wherein the drive circuit comprises a third switching element connected between the second inductor and the first connection of the power supply.

6. The drive circuit as claimed in claim 1, wherein the drive circuit comprises a third circuit element which permits current flow in only one direction and which is connected in series between the second inductor and the first power supply connection.

7. The drive circuit as claimed in claim 1, wherein the drive circuit comprises a fourth switching element connected between the first inductor and the second connection of the power supply.

8. The drive circuit as claimed in claim 1, wherein the drive circuit comprises a fourth circuit element which permits current flow in only one direction and which is connected in series between the first inductor and the second power supply connection.

9. The drive circuit as claimed in claim 1, wherein the drive circuit comprises a fifth circuit element which permits current flow in only one direction and which is connected in series between the second inductor and the second power supply connection.

10. The drive circuit as claimed in claim 1, wherein the or each switching element is a transistor.

11. The drive circuit as claimed in claim 1, wherein the drive circuit comprises a control arrangement to drive waveforms for the switching elements to provide switching directly between substantially fully on and fully off and wherein the on and off switching times being selected to provide the desired drive voltage based on the time for which current flows in the first inductor.

12. The drive circuit as claimed in claim 11 wherein the drive circuit comprises a fourth switching element connected between the first inductor and the second connection of the power supply and wherein the control arrangement may be arranged to switch between a boost mode in which the fourth switching element is used and a normal mode based on the desired voltage.

13. The drive circuit as claimed in claim 11, wherein the printhead drive terminal is connected to power supply to a plurality of nozzle channels and the nozzle channels are connected to a current return path, wherein each of the plurality of nozzle channels is connected in series with a respective nozzle switching element.

14. The drive circuit as claimed in claim 13, wherein the current return path of the nozzle channels is coupled to the second power supply connection.

15. The drive circuit as claimed in claim 13, wherein the control arrangement is arranged to adjust the drive circuit in dependence on the number of nozzle channels being fired based on information concerning the individual nozzle switching elements or a measure of the number of active nozzle channels for a given drive pulse.

16. The drive circuit as claimed in claim 1, wherein the drive circuit has at least one inductor in the drive output and wherein the drive circuit has at least one compensating capacitor in parallel across the printhead and drive terminal to reduce the variation in load capacitance with the number of active nozzle channels.

17. A method of supplying drive power pulses to a plurality of individually switched nozzle channels via the drive circuit as claimed in claim 1, wherein the method comprises the steps of:

a) determining a measure of the number of the nozzle channels of the printhead expected to be active for a given drive pulse; and b) providing a control parameter to the drive circuit such that the drive circuit generates the drive pulse so as to compensate for variation in nozzle channel capacitance.

18. The method as claimed in claim 17, further comprising the step:

c) adjusting the timing signals for the drive circuit.

19. The method as claimed in claim 18, further comprising the step:

d) adjusting the timing signals on the basis of a measured nozzle channel voltage.

20. The drive circuit as claimed in claim 1, further comprising a compensating circuit for the printhead, wherein the plurality of nozzle channels are connected to a common drive connection and in series with individual nozzle control switching elements, wherein the compensating circuit comprises a compensating capacitance arrangement connected to the drive connection to reduce the variation in overall capacitance presented to the drive circuit with variation in the number of active nozzle channels.

* * * * *